US005633478A

United States Patent [19]

Ishino

[11] Patent Number: 5,633,478

[45] Date of Patent: May 27, 1997

[54] COMPOSITE ELECTRICAL INSULATOR AND METHOD OF MANUFACTURING SAME

[75] Inventor: Shigeo Ishino, Niwa-Gun, Japan

[73] Assignee: NGK Insulators, Ltd., Japan

[21] Appl. No.: 583,959

[22] Filed: Jan. 11, 1996

Related U.S. Application Data

[63] Continuation of Ser. No. 210,765, Mar. 21, 1994, abandoned.

[30] Foreign Application Priority Data

Mar. 25, 1993 [JP] Japan ..... 5-066668

[51] Int. Cl.[6] ..... H01B 17/12

[52] U.S. Cl. ..... 174/179; 174/209; 29/887

[58] Field of Search ..... 174/176, 169, 174/178, 179, 180, 181, 182, 74 R, 75 R, 141 R, 152 R, 158 R, 192, 209; 29/887, 517, 521

[56] References Cited

U.S. PATENT DOCUMENTS

| | | | |
|---|---|---|---|
| Re. 32,865 | 2/1989 | Rutledge, Jr. et al. | 174/176 X |
| 3,152,392 | 10/1964 | Coppack et al. | 29/517 |
| 3,192,622 | 7/1965 | Bannerman | 29/517 |
| 3,739,457 | 6/1973 | Davis | 174/176 X |
| 3,898,372 | 8/1975 | Kalb | 174/179 |
| 3,971,128 | 7/1976 | Rebosio | 29/631 |
| 4,130,926 | 12/1978 | Willem | 29/421 |
| 4,296,276 | 10/1981 | Ishihara et al. | 174/179 |
| 4,303,799 | 12/1981 | Ishihara et al. | 174/176 |
| 4,505,033 | 3/1985 | Wheeler | 29/631 |
| 4,654,478 | 3/1987 | Ishihara et al. | 174/176 |
| 4,885,039 | 12/1989 | Thevenet | 156/294 |

FOREIGN PATENT DOCUMENTS

| | | | |
|---|---|---|---|
| 0125421 | 11/1984 | European Pat. Off. | H01B 17/38 |
| 748519 | 7/1980 | U.S.S.R. | 174/176 |
| 910750 | 11/1962 | United Kingdom . | |
| 2015831 | 9/1979 | United Kingdom | H01B 17/06 |

*Primary Examiner*—Hyung S. Sough
*Assistant Examiner*—Paramita Ghosh
*Attorney, Agent, or Firm*—Parkhurst, Wendel & Burr, L.L.P.

[57] ABSTRACT

A composite electrical insulator includes a metal fitting (3, 4) fixedly secured to a fiber-reinforced plastic rod (1) at one end thereof. The rod has a stress-relieved zone (8) situated opposite to the metal fitting (3, 4), and formed by a heat treatment of the rod (1) after an end portion of the rod (1) has been inserted into a bore (5) in the metal fitting (3, 4) and the metal fitting (3, 4) fixedly secured to the rod (1). The heat treatment of the rod (1) is performed at a temperature which is not lower than a heat transition temperature of a matrix resin of the fiber-reinforced plastic material.

9 Claims, 5 Drawing Sheets

COMPOSITE ELECTRICAL INSULATOR AND METHOD OF MANUFACTURING SAME

This is a Continuation of application Ser. No. 08/210,765 filed Mar. 21, 1994, now abandoned.

BACKGROUND OF THE INVENTION

1. Field of the Invention

The present invention relates generally to a composite electrical insulator wherein a metal fitting is fixedly secured to a fiber-reinforced plastic rod at one end thereof.

2. Description of the Relater Art

A composite electrical insulator with such a constitution is known, e.g., from U.S. Pat. No. 4,654,478, wherein one end portion of the fiber-reinforced plastic rod is inserted into the bore in a sleeve portion of the metal fitting and the metal fitting is then fixedly secured to the plastic rod. To this end, the metal fitting is compressed radially inwardly onto the plastic rod so as to firmly clamp the rod. That is to say, by compressing the metal fitting radially inwardly, that region of the plastic rod situated opposite to the metal fitting is uniformly clamped to integrally connect the metal fitting with the plastic rod and prevent withdrawal of the plastic rod from the fitting even under a large tensile force.

In order to satisfy a severe requirement for a high tensile strength, the metal fitting is usually comprised of a high tension steel or ductile cast iron. However, due to the rigidity of the metal fitting which is considerably higher than that of the fiber-reinforced plastic rod, even a slight unevenness in the outer surface of the rod end portion or the inner surface of the bore in the metal fitting may cause a local deformation in adjacent outer surface region of the rod, thereby giving rise to considerable residual internal stresses. In this instance, when the insulator is applied with an external force, typically an axial tensile force, the internal stress is multiplied in the end portion of the rod which is clamped within the sleeve, causing a high degree of stress concentration and thereby giving rise to damage or breakage of the rod within a relatively short period. It has thus been considered necessary to perform highly accurate and precise machining with respect to the inner surface of the bore in the metal fitting and the outer surface of the rod end portion. Needless to say, such machining often makes it difficult to improve the manufacturing productivity and reduce the cost of the insulators.

Similar problems may arise also when the radially inwardly directed compression of the fiber-reinforced plastic rod exhibits a non-uniform distribution in the circumferential direction of the rod in any cross-section of the metal fitting. Therefore, it has been considered an indispensable condition for the insulators to have a structure wherein the plastic rod is compressed radially inwards with a practically satisfactory uniformity.

SUMMARY OF THE INVENTION

It is therefore a primary object of the present invention to provide an improved composite electrical insulator which can be used for a prolonged period with satisfactory durability and reliability, and which can be yet manufactured with a higher productivity and at a reduced cost.

It is another object of the present invention to provide a method of manufacturing improved composite electrical insulators with a higher productivity and at a reduced cost.

According to one aspect of the present invention, there is provided a composite electrical insulator which comprises:

a rod comprised of a fiber-reinforced plastic material and having an end portion; and a metal fitting having a sleeve portion formed with a bore into which said end portion of the rod is inserted so that said metal fitting is fixedly secured to said rod; wherein said rod comprises a stress-relieved zone situated opposite to said metal fitting.

According to another aspect of the present invention, there is provided a method of manufacturing a composite electrical insulator including a rod comprised of a fiber-reinforced plastic material having an end portion to which a metal fitting is fixedly secured, wherein said method comprises the steps of: inserting said end portion of the rod into the bore in the metal fitting and fixedly securing said rod to said metal fitting; and subsequently relieving a stress in that zone of said rod which is situated opposite to said metal fitting.

That is to say, for manufacturing the composite electrical insulator in accordance with the present invention, the end portion of the fiber-reinforced plastic rod is inserted into the sleeve portion of the metal fitting and the rod is then fixedly secured to the metal fitting. The zone of the rod situated opposite to the metal fitting is then subjected to a stress relief, e.g., by a heat treatment of the sleeve portion of the metal fitting so that the rod is locally heated to a temperature not lower than the heat transition temperature of the matrix resin of the rod.

The term "heat transition temperature" of the matrix resin, as used herein, refers to a critical temperature which causes a transformation of the mechanical property of the matrix resin from an ordinary resilient body in a room temperature condition to a plastically deformable body in an elevated temperature condition, and vice versa. The term "heat transition temperature" may be used synonymous with "glass transition temperature".

As a result, in any cross-section of the metal fitting, the pressure exerted by the metal fitting to the rod can be uniformly distributed along the entire periphery of the rod so that the rod can be uniformly compressed radially inwards, thereby effectively preventing an external force is applied to the rod end portion from being subjected to undesirable stress concentration even when the insulator. It is thus possible to avoid premature damage or breakage of the fiber-reinforced plastic rod and significantly prolong the serviceable life of the insulator.

Moreover, the uniform distribution of the pressure exerted by the metal fitting to the rod can be achieved without requiring accurate and precise machining of the rod and the metal fitting, so that the insulator can be manufactured with an improved productivity and at a reduced cost.

BRIEF DESCRIPTION OF THE DRAWINGS

The present invention will be further explained in detail hereinafter with reference to the accompanying drawings, in which.

DESCRIPTION OF THE PREFERRED EMBODIMENTS

Figure 1:
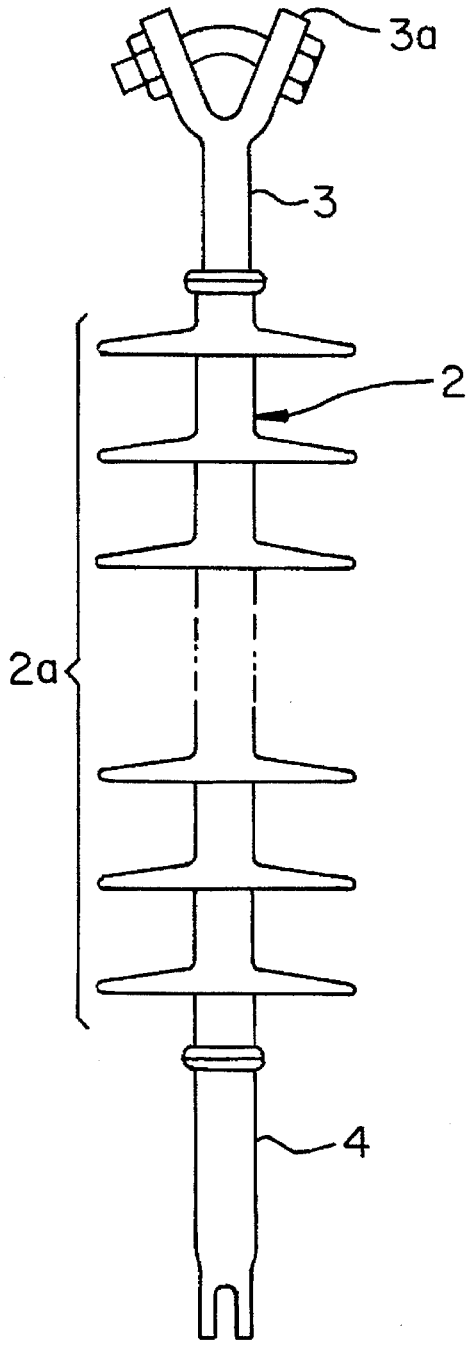
FIG. 1 is a front view schematically showing a general arrangement of a composite electrical insulator according to one embodiment of the present invention.
Figure 2:
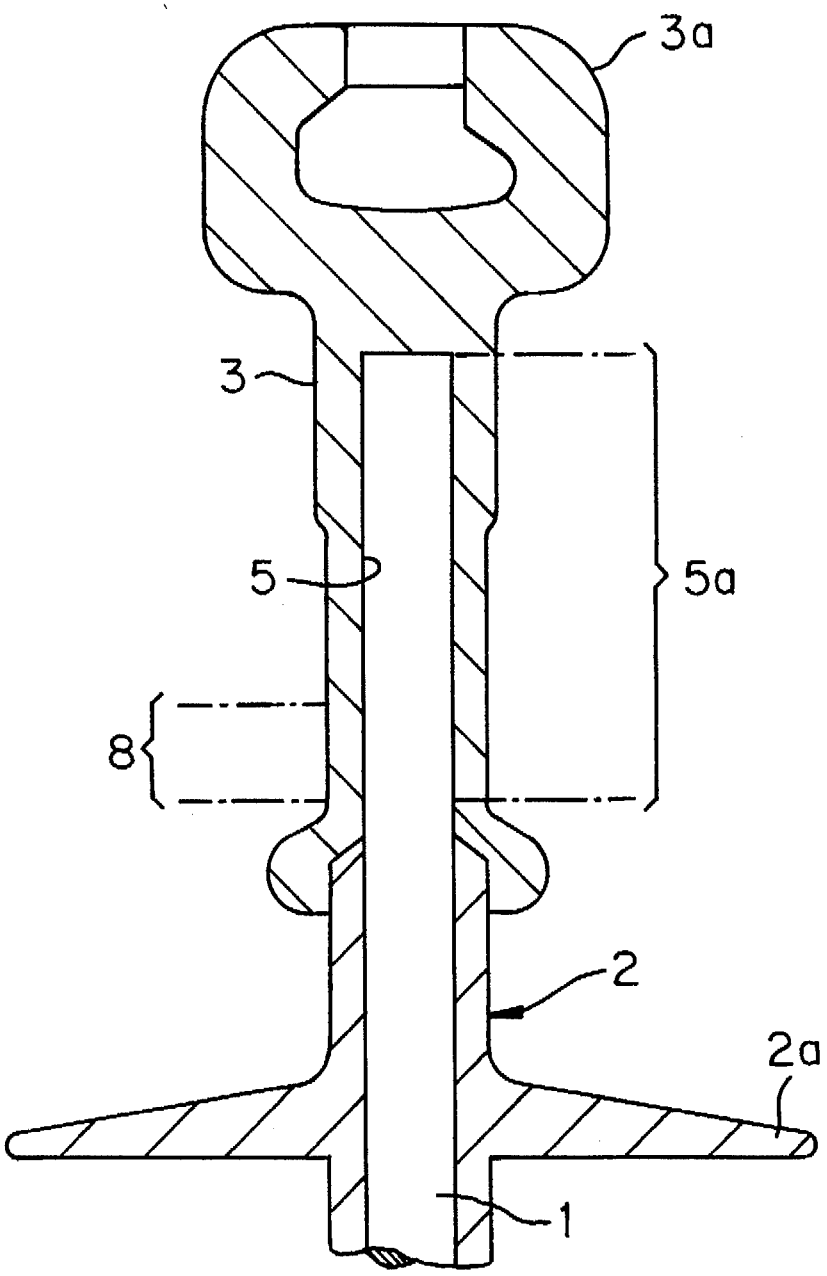
FIG. 2 is a longitudinal-sectional view showing an axial end region of the insulator of FIG. 1.

Referring now to FIGS. 1 and 2, there is shown a composite electrical insulator according to one embodiment of the present invention. The insulator includes a rod 1 comprised of a fiber-reinforced plastic material, which may be referred as "FRP rod" hereinafter. The rod 1 is covered, either locally or entirely, by an insulating sheath 2 which is comprised of an appropriate electrically insulating resilient material and provided with a series of shed portions 2*a*. These shed portions 2*a* are axially spaced from each other in a conventional manner, so as to preserve a desired surface leakage distance. The insulator has a voltage application side and a ground side illustrated on the upper side and lower side in the drawings, respectively, to which metal fittings 3 and 4 are fixedly secured, respectively.

The fiber-reinforced plastic material forming the rod 1 may comprise knitted or woven fibers or bundles of longitudinally oriented fibers, such as glass fibers or other appropriate fibers having a high modulus of elasticity, and a thermosetting type synthetic resin, such as epoxy resin, polyester resin or the like, impregnated in the fibers as a matrix resin. Thus, the rod 1 has a high tensile strength and, hence, a high strength-to-weight ratio. The metal fittings 3 and 4, in turn, may each comprise a high tension steel, aluminum, ductile iron or other appropriate metal.

As particularly shown in FIG. 2, the metal fitting 3 has a sleeve portion which is formed with a longitudinal bore 5 for receiving a corresponding axial end portion of the rod 1. After the axial end portion of the rod 1 has been inserted into the bore 5 in the metal fitting 3, a clamp region 5*a* in the sleeve portion which extends over the end portion of the rod 1 is subjected to caulking so as to fixedly secure the metal fitting 3 to the rod 1. The metal fitting 3 on its free end 3*a* remote from the rod 1 is adapted to be directly or indirectly connected to an electric cable, support arm of a tower and the like. To this end, the free end 3*a* of the metal fitting 3 is formed as a bifurcated clevis (FIG. 1) or as a connection eye (FIG. 2).

As mentioned above, the insulating sheath 2 is comprised of an electrically insulating resilient material. Such material may be, e.g., silicone rubber, ethylenepropylene rubber or the like. The shape of the insulating sheath 2 and the region of the rod end portion 1 to be covered by the insulating sheath 2 may be designed in a conventional manner, in view of a proper avoidance of electrical contamination.

The manner of fixedly securing the rod 1 to the metal fitting 3 on the ground side, by way of example, will be explained below with reference to a typical arrangement of the composite insulator wherein the rod 1 is entirely covered by the insulating sheath 2. It should be noted in this connection that the following explanation applies also to the metal fitting 4 on the voltage application side.

Figure 3:
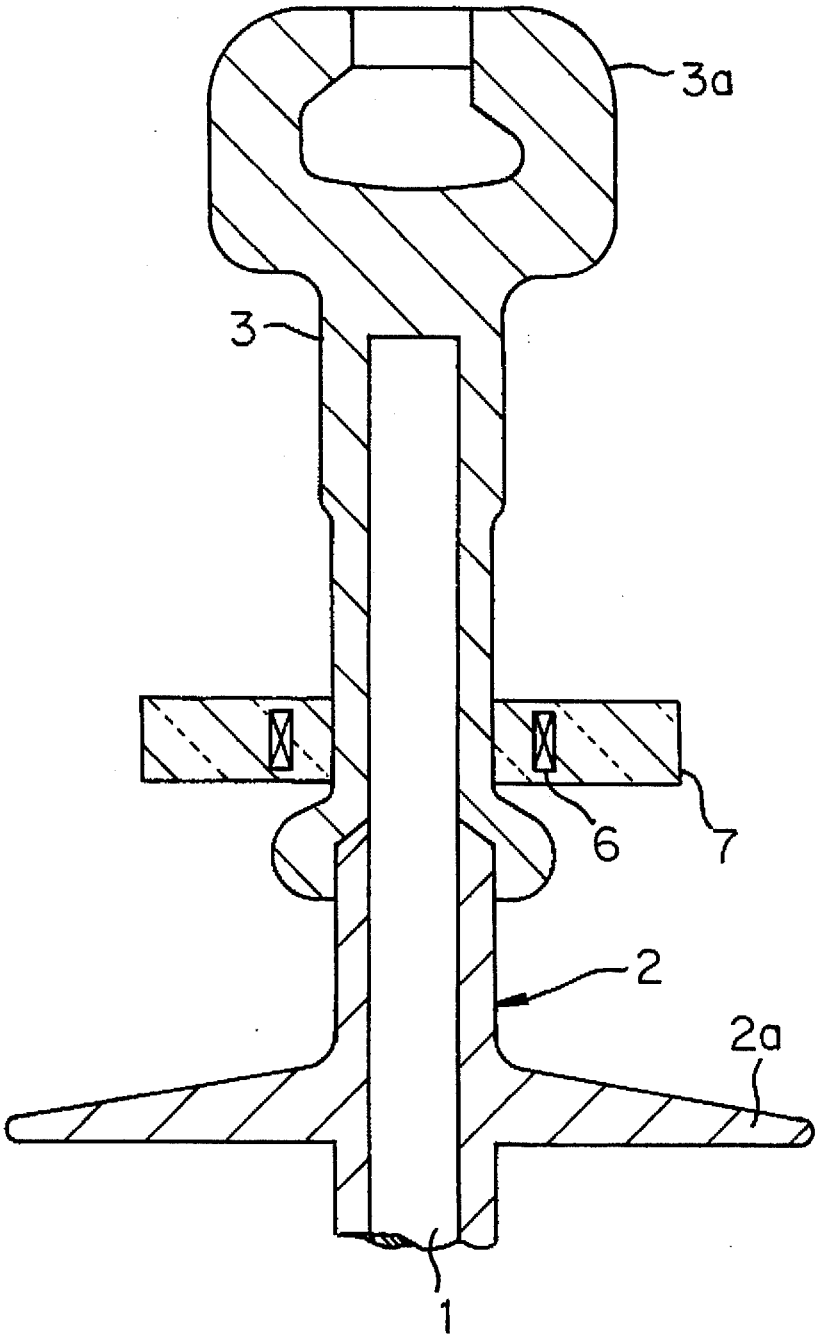
FIG. 3 is a longitudinal-sectional view showing the manner of applying a heat treatment to the sleeve portion of the metal fitting shown in FIG. 2.

At the outset, the end portion of the rod 1 is inserted into the bore 5 in the the metal fitting 3 which is then subjected to caulking so as to fixedly secure the metal fitting 3 to the rod 1. The caulking causes the metal fitting 3 to exert radially inwardly directed pressure on the rod 1 so that rod end portion assumes a slightly reduced diameter. Subsequently, as shown in FIG. 3, the clamp region 5*a* in the sleeve portion of the metal fitting 3 is surrounded by an annular heater element 6 of a heating device 7. The heating device 7 is then operated so as to locally heat the sleeve portion of the metal fitting 3, thereby generating a temperature gradient with the peak temperature at the clamp region 5*a* of the metal fitting 3 surrounded by the heating device 7.

In this connection, the heat quantity to be generated by the heating device 7 is determined such that a particular zone 8 of the rod end portion, which is situated opposite to the clamp region 5*a* of the metal fitting 3 surrounded by the heater element 6, is heated to a temperature which is not lower than the heat transition temperature of the matrix resin of the fiber-reinforced plastic material forming the rod 1.

That is to say, the clamp region 5*a* of the metal fitting 3 surrounded by the heating device 7 is heated to a suitable temperature which may be approximately 30° C. higher than the heat transition temperature of the the matrix resin of the FRP rod 1, for a duration of, e.g., approximately 15 min. However, it should be noted in this connection that an excessively elevated temperature of the FRP rod 1 may cause a thermal deterioration of the mechanical characteristics.

During the operation of the heating device 7, the matrix resin in a zone 8 which is being heated by the heating device 7 behaves as a plastically deformable body and thus undergoes a flow deformation to absorb any local elastic deformation which had been caused by unevenness on the inner surface of the bore 5 and/or the outer surface of the rod end portion.

Thereafter, by stopping the operation of the heating device 7, the end portion of the rod 1 is gradually cooled down to room temperature. The heat-treated zone 8 in the rod end portion then behaves as an ordinary resilient body as having been plastically deformed into exact and permanent conformity with the inner surface of the bore 5 in the metal fitting 3. Therefore, notwithstanding the original elastic deformation of the FRP rod 1 as caused by caulking and the like to fixedly secure the rod 1 to the metal fitting 3, the heat-treated zone 8 in the rod end portion of the insulator as a final product is in a sufficiently stress-relieved state and serves to suppress a local stress concentration as well.

As a typical example, the FRP rod 1 has an original outer diameter of 16 mm, and the clamp region 5*a* of the metal fitting 3 extending over the rod end portion has an axial length of 70 mm. In this instance, the heat-treated zone 8 in the rod end portion may have an axial length of 20 mm, which is larger than the original diameter of the rod 1. However, this is not a prerequisite condition; the axial length of the heat-treated zone 8 in the rod end portion may be suitably determined primarily in view of the mechanical characteristics required for the composite insulator.

In order to confirm the distinguished advantages achieved by the heat treatment in accordance with the present invention, a set of composite insulators with the heat treated zone 8 and another set of conventional composite insulators without any heat treated zone were prepared as samples to measure their serviceable lives. The FRP rods of these samples were comprised of a matrix resin having a heat transition temperature of 110° C., and fixedly secured to the metal fittings 3, 4 on both sides by caulking. The metal fittings 3, 4 in the set of samples with the heat treated zone 8 were heated to a temperature of 140° C. for 15 minutes, with a heating device 7 as shown in FIG. 3.

Figure 4:
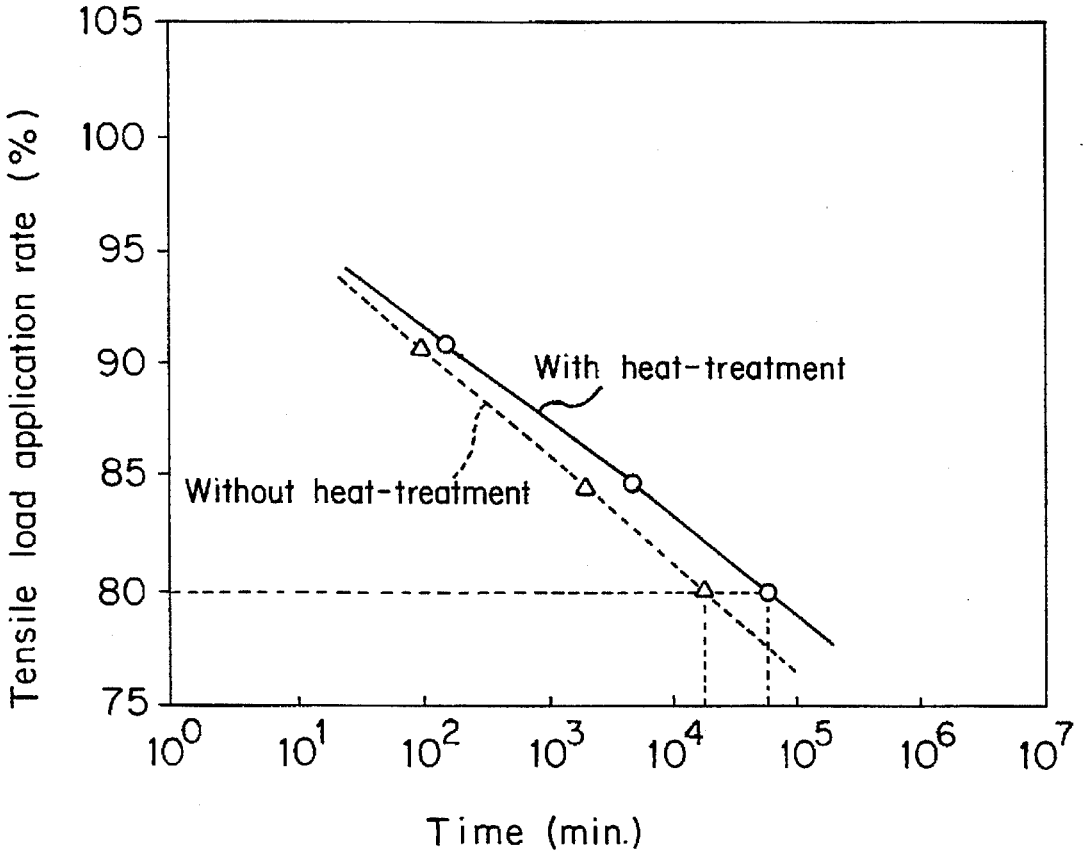
FIG. 4 is a graph showing the relationship between the tensile load and the serviceable life of the insulator according to the present invention.

These samples were then subjected to a tensile strength test, by applying predetermined tensile forces of various levels to measure the time length until rupture of the samples induced by the tensile force has been found. The result of such tensile test is shown in FIG. 4, wherein the applied tensile forces are represented by indices, with a short-period tensile strength as 100. It can be clearly appreciated from FIG. 4 that the heat treated zone 8 according to the present invention provides an improved serviceable life of the composite insulators, which, for example, is 3.8 times longer than that of the conventional composite insulators without the heat-treated zone in the case of an 80% load condition.

Further embodiments of the present invention will be briefly explained below with reference to FIGS. 5 and 6, wherein reference numerals used in FIGS. 1 to 3 denote the same or corresponding elements for which superfluous explanations are omitted for the sake of simplicity.

Figure 5:
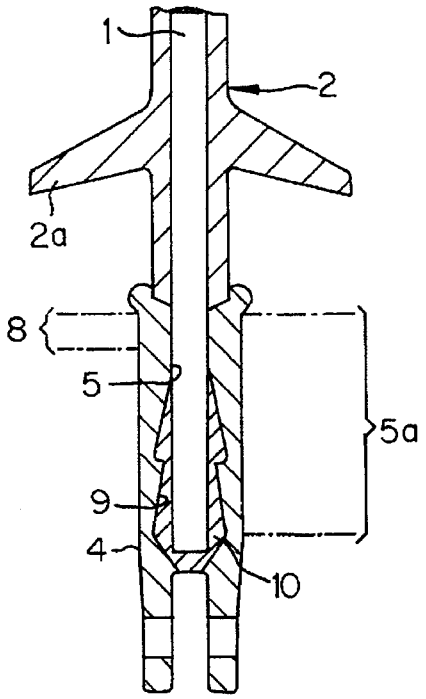
FIG. 5 is a longitudinal-sectional view showing another embodiment of the present invention.

In the embodiment shown in FIG. 5, the metal fitting 4 on the voltage application side of the composite insulator has a sleeve portion formed with a bore 5 which is featured by a unique arrangement for providing a further improved connection between the FRP rod 1 and the metal fitting 4 in a normal use condition of the insulator. Specifically, the inner surface of the bore 5 in the metal fitting 4 has a series of tapered regions 9 which are longitudinally spaced from each other. Thus, there is formed a longitudinally multi-stepped space between the outer surface of the FRP rod end portion and the inner surface of the bore 5, which is filled by an appropriate adhesive resin 10. The arrangement of the tapered regions 9 is such that, when the insulator is applied with an axial tensile force in a normal use condition, the tapered regions 9 function as wedges for generating a force applied to the FRP rod 1 radially inwards, thereby improving the clamp strength.

Figure 6:
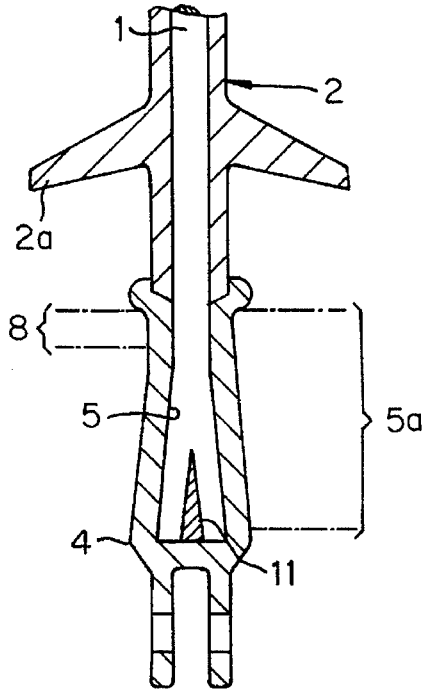
FIG. 6 is a longitudinal-sectional view showing still another embodiment of the present invention.

In still another embodiment shown in FIG. 6, both the inner surface of the bore 5 of the metal fitting 4 on the voltage application side and the outer surface of the FRP rod 1 are tapered into conformity with each other. The tapered region in the outer surface of the rod end portion is formed by a wedge 11 which has been axially press-fitted into the end portion of the rod 1. The wedge 11 serves to tightly urge the outer surface of the FRP rod 1 against the inner surface of the bore 5 of the metal fitting 4, thereby to provide an improved clamp strength even when the insulator is applied with an axial tensile force in a normal use condition.

It is of course that the ground side metal fitting may have a structure similar to those shown in FIGS. 5 and 6.

It will be appreciated from the foregoing description that the heat treatment of the FRP rod end portion according to the present invention, which is performed after the metal fitting has been fixedly secured to the FRP rod, serves to provide improved durability and reliability of the composite insulator and maintain improved mechanical characteristics for a prolonged period. It should be further noted that the composite insulator according to the present invention can be manufactured with an improved productivity and at a reduced cost.

While the present invention has been described with reference to certain preferred embodiments, they were given by way of examples only. It is of course that various changes and modifications may be made without departing from the scope of the present invention as defined by the appended claims.

For example, changes may be made in view of various specifications of the composite insulator, with respect to the axial length of the heat treated zone 8 of the FRP rod 1 and/or the axial length of the clamp region 5*a* of the metal fittings 3, 4 extending over the rod end portion, or with respect to the temperature, time length or method of the heat treatment.

Also, it is possible to perform an initial caulking of a part of the clamp regions 5*a* of the metal fittings 3, 4, subject the entire metal fittings 3, 4 to a heat treatment in an oven, and thereafter perform a final caulking of the the clamp regions 5*a*. In this instance, it is possible to reduce the axial length of the clamp regions 5*a* of the metal fittings 3, 4 by performing an additional caulking of the metal fittings 3, 4 with respect to the heat treated zone 8.

I claim:

1. A composite electrical insulator comprising:

a rod comprised of a fiber-reinforced plastic material and having an end portion; and a metal fitting including a sleeve portion having a bore into which said end portion of the rod is inserted, said metal fitting being fixedly secured to said rod provided in said sleeve portion by caulking the sleeve portion;

wherein a portion of the rod that extends along a caulked region of the sleeve portion is locally heated to form a stress-relieved zone in the rod.

2. The insulator according to claim 1, further comprising means for generating a force which is applied to said rod radially inwardly upon application of an axial tensile force to said rod.

3. The insulator according to claim 2, wherein at least one of an outer surface of the end portion of the rod and an inner surface of the bore in the sleeve portion of the metal fitting has at least one tapered surface region, said insulator further comprising a resin which is filled in a space between said outer surface of the end portion of the rod and said inner surface of the bore in the sleeve portion of the metal fitting.

4. The insulator according to claim 2, wherein an outer surface of the end portion of the rod and an inner surface of the bore in the sleeve portion of the metal fitting have tapered surface regions, respectively, said tapered surface region of the outer surface of the end portion of the rod being formed by a wedge which has been axially press-fitted into the end portion of the rod.

5. The insulator according to claim 1, further comprising an insulating sheath comprised of an electrically insulating resilient material, for enclosing said rod.

6. A method of manufacturing a composite electrical insulator, comprising the steps of:

providing a rod comprised of a fiber-reinforced plastic material and having one end portion, and a metal fitting including a sleeve portion having a bore;

inserting said end portion of the rod into the bore in the sleeve portion of the metal fitting;

fixedly securing said rod provided in the sleeve portion of the metal fitting by caulking the sleeve portion; and subsequently locally heating a portion of the rod that extends along a caulked region of the sleeve portion to form a stress-relieved zone in the rod.

7. The method according to claim 6, wherein said rod is locally heated to a temperature which is not lower than a heat transition temperature of a matrix resin of said fiber-reinforced plastic material.

8. The method according to claim 7, wherein said local heating is carried out at a temperature which is approximately 30° C. higher than said heat transition temperature of the matrix resin.

9. The method according to claim 7, wherein said local heating is carried out for approximately 15 minutes.

* * * * *